US008056648B2

(12) United States Patent
Weddfelt

(10) Patent No.: US 8,056,648 B2
(45) Date of Patent: Nov. 15, 2011

(54) METHOD AND DEVICE

(75) Inventor: Kenneth Weddfelt, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 12/799,130

(22) Filed: Apr. 19, 2010

(65) Prior Publication Data

US 2010/0258326 A1 Oct. 14, 2010

Related U.S. Application Data

(62) Division of application No. 11/919,564, filed as application No. PCT/SE2006/000581 on May 19, 2006, now Pat. No. 7,886,843.

(30) Foreign Application Priority Data

May 23, 2005 (SE) ..... 0501150

(51) Int. Cl.
*E21B 44/00* (2006.01)

(52) U.S. Cl. ..... 175/40; 175/296

(58) Field of Classification Search ..... 175/24, 175/26, 40, 296
See application file for complete search history.

(56) References Cited

U.S. PATENT DOCUMENTS 4,699,223 A * 10/1987 Noren ..... 175/40
2005/0150830 A1* 7/2005 Laugharn et al. ..... 210/634
* cited by examiner

*Primary Examiner* — William P Neuder
(74) *Attorney, Agent, or Firm* — Mark P. Stone

(57) ABSTRACT

The present invention relates to a method for controlling a rock drilling process, in which an impulse-generating device comprising an impact element transmits a shock wave to a tool connected to the impulse-generating device, whereby a portion of the energy of the shock wave is transmitted to the rock by means of the tool and a portion of the energy of the shock wave is reflected and brought back to the impulse-generating device as reflected energy. The method comprises steps of generating at least one parameter value representing the reflected energy, and regulating the interaction of said impact element with said tool at least partially based on said value or values to control the rise time and/or length of said shock wave. The invention also relates to a regulation device, an impulse-generating device and a drilling rig.

17 Claims, 4 Drawing Sheets

METHOD AND DEVICE

The present application is a Divisional of Ser. No. 11/919,564, filed on Oct. 30, 2007 now U.S. Pat. No. 7,886,843 (currently pending before the Patent and Trademark Office), which is the U.S. National Phase of PCT/SE2006/000581, filed on May 19, 2006 pursuant to 35 U.S.C. Section 371, which claims priority from Swedish Patent Application No. 0501150-7, filed on May 23, 2005, pursuant to 35 U.S.C. Section 119 (a).

FIELD OF THE INVENTION

The present invention relates to a device and a method for Controlling an impulse-generating device for drilling in rock.

BACKGROUND OF THE INVENTION

In rock drilling, a drilling tool is used that is connected to a rock-drilling device via one or more drill string components. The drilling can be carried out in several ways, a common method being percussive drilling where an impulse-generating device, a striking tool, is used to generate impacts by means of an impact piston that moves forward and backward. The impact piston strikes the drill string, usually via a drill shank, in order to transfer impact pulses to the drilling tool via the drill string, and then on to the rock to deliver the energy of the shock wave. The impact piston is typically driven hydraulically or pneumatically, but can also be driven by other means, such as by electricity or some form of combustion.

In another kind of impulse-generating devices the shock wave energy is generated as pressure impulses which are transferred to the drill string from an energy storage by means of an impact element that performs only a very small motion instead of, as described above, being generated as released kinetic energy by a piston moving backwards and forwards.

An example of such a device is a device where an impact element is pre-loaded using a counter-pressure chamber, and where the energy is transferred to the drill string by means of the impact element by a sudden reduction of the pressure in the counter-pressure chamber.

Another example of such a device is a device where a working chamber is arranged in front of the impact element instead of using a counter-pressure chamber, and wherein the shock waves are generated by supplying pressure medium of high pressure in form of pressure pulses to the working chamber from an energy storage.

According to the currently known technology, such solutions generate shock waves with lower energy, and, in order to maintain the efficiency of the drilling, the lower energy in each shock wave is compensated for by the shock waves being generated at a higher frequency.

A problem with all the abovementioned impact-generating devices is that available impact energy is not fully made use of.

OBJECTS OF THE INVENTION AND MOST IMPORTANT CHARACTERISTICS

An object of the present invention is to provide a method for controlling a rock drilling process that solves the abovementioned problem.

Another object of the present invention is to provide a regulation device at an impulse-generating device that solves the abovementioned problem.

According to the present invention there is provided a method for controlling a rock drilling process, with an impulse-generating device comprising an impact element transmits a shock wave to a tool connected to the impact-generating device, where a portion of the energy of said shock wave is transmitted to the rock by means of the tool and a portion of the shock wave energy is reflected and returned to the impulse-generating device as reflected energy. The method comprises the steps of generating at least one parameter value that represents the reflected energy, and to control the interaction of the impact element with the tool at least partially based on said value or values to control the rise time of said shock wave and/or the length of said shock wave. This has the advantage that the form of the shock wave at all times can be controlled based on current conditions to thereby keep harmful reflection energies at an minimum, below a predetermined value, or at a value that has been determined in relation to other demands on the drilling process.

The amplitude of the shock wave can also be controlled. This has the advantage that even larger possibilities of optimum control of the rock drilling device is provided.

At least one damping pressure in at least one damping chamber may constitute a representative quantity of the reflected energy. Alternatively, the quantity may constitute the strain of one or more strain gauges. This has the advantage that the reflection can be read in a simple manner.

The value or values representing the reflected energy may be generated continuously, acyclic, with predetermined intervals and/or when generating each or certain shock waves. This has the advantage that current input parameters for the regulation may always be available.

The present invention also relates to an impulse-generating device and a drilling rig.

DETAILED DESCRIPTION OF PREFERRED EMBODIMENTS

Figure 1A:
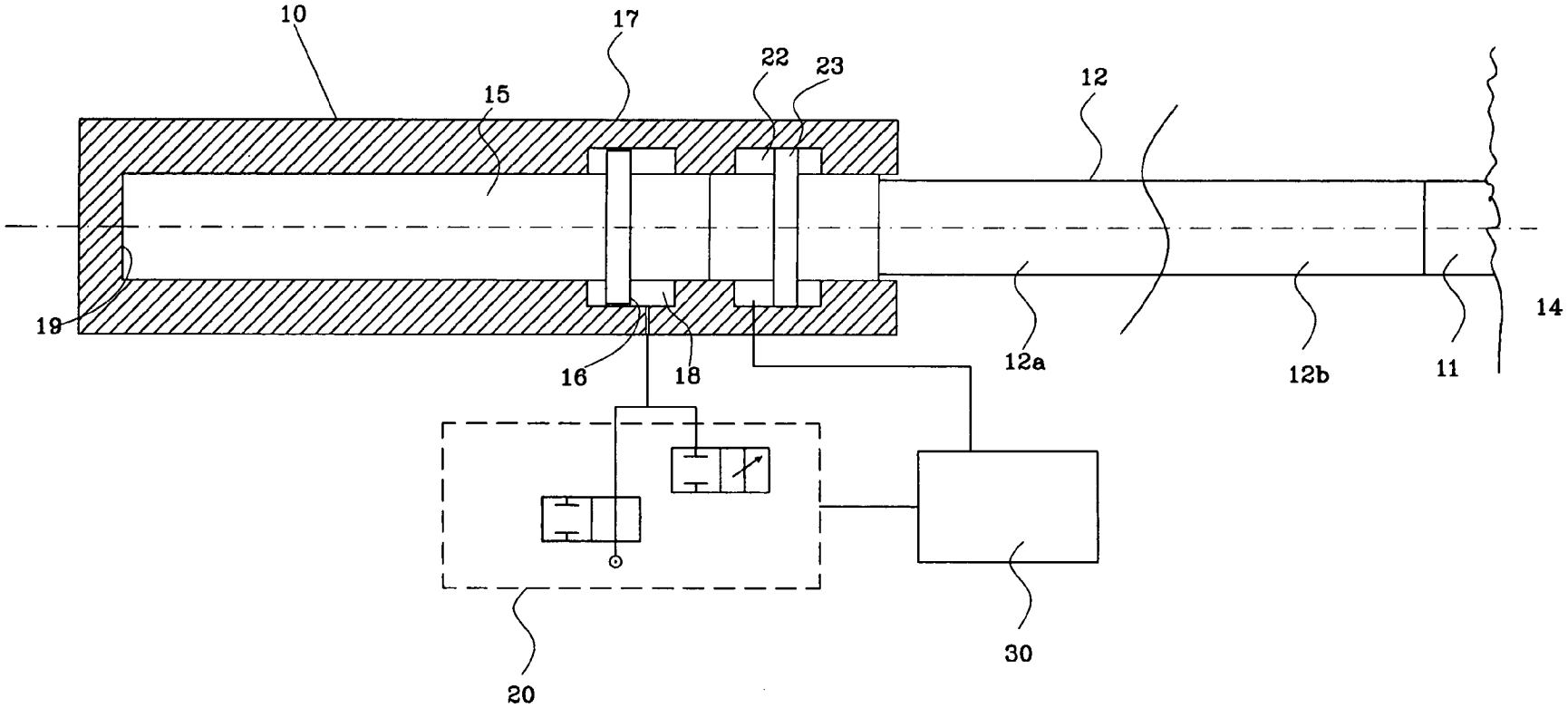
FIG. 1 schematically shows a control and regulating device for an impact-generating device according to the preferred embodiment of the present invention.
FIG. 1*b* shows an example of a device with which the present invention advantageously may be utilized.

FIG. 1*a* shows an impulse-generating device 10 for a rock-drilling device that can advantageously be used with the present invention. During operation, the device 10 is connected to a drill tool such as a drill bit 11 via a drill string 12 consisting of one or more drill string components 12*a*, 12*b*. During drilling, energy in the form of shock waves is transferred to the drill string 12, and then from the drill string component 12*a*, 12*b* to drill string component 12*a*, 12*b* and finally to the rock 14 via the drill bit 11, for breaking the rock 14.

In the device 10 illustrated, a piston that moves forward and backward is not used to generate the shock waves, but instead a loaded impact element in the form of an impact piston 15 is used, which is urged towards the end of a housing 17 that is opposite to the drill string 12 by the effect of a pressure medium acting against a pressure area 16. During operation, a chamber 18 is pressurized via a control device 20 so that the pressure in the chamber 18 acts on the pressure area 16 and thereby urges the impact piston 15 towards the rear end 19 of the housing 17. The chamber 18 thus acts as a counter-pressure chamber.

Figure 2A:
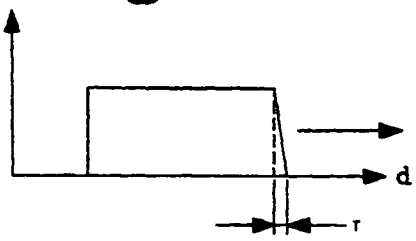
FIGS. 2*a*-2*e* shows examples of wave forms of shock waves and reflection waves.

In known technology, a control valve in the control device 20 is then opened suddenly to create an immediate reduction of pressure in the counter-pressure chamber 18, whereupon the impact piston 15 expands to its original length and transmits potential energy to the drill string 12 in the form of a shock wave. This sudden reduction of pressure generates a shock wave of essentially the same form as a shock wave generated by a normal impact piston, that is a principally rectangular form, see FIG. 2*a*, which propagates through the drill string to the drill bit 11 for transmission to the rock 14. On account of the characteristics of the rock 14, however, all the energy of the shockwave cannot be taken up by the rock on account of the short rise time of the shock wave (see $\tau$ in FIG. 2*a*; in the figure, $\tau$ is exaggerated for the sake of clarity; $\tau$ can be considerably shorter, that is the edge can be considerably steeper), but instead a part of the provided energy is reflected and returned to the impulse-generating device 10 through the drill string 12. The reflections from the drill steel rock impact is dampened using a damping chamber 22 and a damping piston 23. The function of these is well known to a person skilled in the art. The damping pressure in the damping chamber may also be used to ensure that the drill bit 11 is in contact with the rock when the impact piston 15 hits the drill string 12. Even if the reflections is dampened, these reflections still have an adverse effect on the rock-drilling device and drill string and can cause wear of various components and serious damage as a result.

By means of the regulation device 30 according to the invention that is shown in FIG. 1*a*, these harmful reflections can, however, be reduced considerably. Instead of the reduction of pressure taking place suddenly, the opening of the control device 20 of the shown device 10 can be controlled, that is, the control device 20 can control the reduction of pressure in the counter-pressure chamber 18. By controlling the opening of the counter-pressure chamber using the control valve 20, the rise time of the shock wave induced in the drill string, and hence in the drill bit, can be controlled. This is very advantageous, since the force that the drill bit can transmit to the rock varies with the depth of penetration of the drill bit.

Figure 2B:
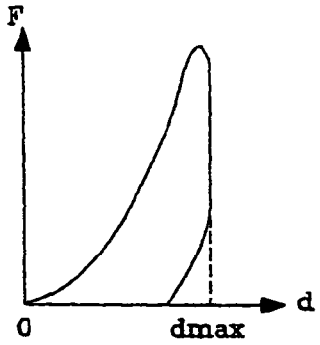

FIG. 2*b* shows an example of the penetrating force as a function of the penetration depth for an exemplary type of rock. As can be seen in the figure, the penetrating force that the drill bit can transmit to the rock is essentially zero at the moment of impact (d=0) and then increases exponentially with the penetration depth until the shock wave reaches its end and the penetration reaches its maximum ($d=d_{max}$) and there is accordingly no longer any energy for further penetration, after which the penetration force rapidly drops to zero and, as can be seen in the figure, the drill bit is moved backward slightly by the elasticity of the rock and/or by reflection.

Figure 2C:
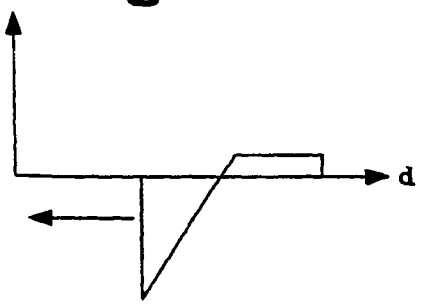

FIG. 2*c* shows the appearance of the reflection wave for the device according to known technology. As the penetration force of the drill bit is zero or essentially zero at the moment of impact, the amplitude of the reflection wave at this moment will, in principle, correspond to the amplitude of the incident shock wave, however as a tension wave. If the edge of the shock wave is very steep, as in FIG. 2*a*, this thus means that the reflection wave will have very high and hence harmful initial amplitude.

During the regulation, information regarding the size of the resulting reflection when the shock wave hits the rock is needed. The reflection may be read from the pressure change that occurs in the damping chamber 22 when the reflected wave reaches the drilling machine. In particular, the maximum pressure change appearing in the damping chamber is directly related to the amplitude of the reflection wave. In operation, the regulation device 30 continuously or at certain intervals receives measurements representing the damping pressure in the damping chamber 22. If needed, the measurement values may be converted to an appropriate quantity in the regulation device 30 or in a measurement value converter (not shown) connected to the regulation device 30. The damping pressure may be read in a suitable way, e.g., during measurement, sensing or monitoring. The exact way of appropriately reading the damping pressure constitutes knowledge known, to a person skilled in the art. The obtained measurement value is then compared to the value of the damping pressure that was obtained at the previous measurement, e.g., the reflection of the previous shock wave, whereupon the rise time and/or length and/or amplitude of the shock wave is regulated based on the comparison in coming impacts using the control device 20.

The damping pressure is preferably measured continuously or using such frequent intervals that the regulation of the form of the shock wave, i.e. rise time and/or length and/or amplitude, based on the reflection of a certain shock wave can be performed already at the generation of the very next shock wave. When shock waves are generated using a very high frequency it may, however, be possible that the calculation of new regulation parameters is not finished in time for the generation of the next shock wave but perhaps not until the shock wave following thereafter or an even later shock wave.

In order to obtain an accurate value of the reflection the damping pressure may, in stead of only reading the size of the pressure change, be very frequently read so that a reproduction of the reflection wave form may be obtained. In this way, an accurate value of the size of the reflected energy may be obtained by performing a numerical algorithm of the obtained wave form.

As an alternative to measuring the reflection using damping pressure this may also be performed, e.g., by use of a strain gauge. The strain gauge is then mounted on a suitable part of the rock drilling device, said part being exerted to tensile stress/compressive stress by the reflection wave. The optimum position is on the drill string. This however may be hard to perform since the drill string often is rotated during drilling in a conventional manner and with regular intervals is provided with extension components. The positioning may thus vary from machine to machine and exactly how and which positioning that is used is within the scope of knowledge of a person skilled in the art. The essential for the invention is that a signal representing the appearance of the reflection is obtained. When using strain gauge it is also possible to, as above, obtain a wave form description of the appearance of the reflection wave.

Figure 2D:
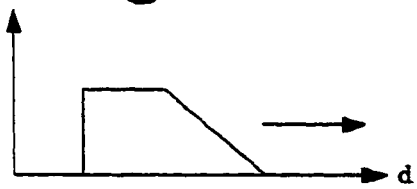
Figure 2E:
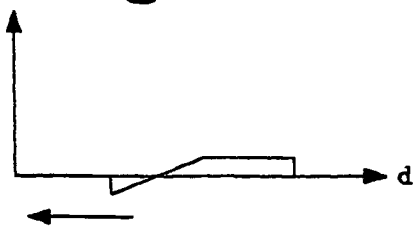

The regulating device may further be arranged to try to minimize the reflected energy at all times. In this kind of regulation, the drilling may be started using an unregulated shock wave, i.e., in this embodiment with the reduction of the pressure totally unregulated (alternatively, the minimizing regulation is started at a predetermined rise time and/or shock wave length and/or shock wave amplitude, wherein various predetermined initial values for various types of rock may be stored in a memory in the regulation device 30), whereafter, when the drilling has started, the regulation device continuously or at certain times obtains measurement values representing the reflected energy, and then sends control signals to the control device 20 to regulate the form of the shock wave based on these measurement values. For example, the regulation may be arranged such that the inclination of the edge of the shock wave is gradually increased, i.e., that the duration of the reduction of pressure of the counter-pressure chamber continuously increases by a certain value Δt, so that the time of reduction of pressure is $t=t_f\Delta t$, wherein $t_f$ is the time of reduction of pressure at the previous regulation, e.g., at the previous impact, for as long as the value representing the reflection energy (i.e., the reflected energy calculated by a numerical algorithm or the measured damping pressure change) is influenced in a desired direction. When the reflection-reaches a minimum, i.e., an increase in the duration of the reduction of pressure does not result in any further reduction (a larger inclination of the edge) the regulation can be kept about the desired value. When minimizing the reflected energy, there is a risk that the edge of the shock wave is built up under such a long time that the penetration rate substantially is reduced. For this reason, the regulation may instead be aimed at a predetermined highest value of the reflection energy and/or highest allowable reflection amplitude. The predetermined value may, e.g., be inputted by an operator. When regulating about the predetermined value the edge time may of course also be allowed to be reduced, i.e., the above mentioned time of reduction of pressure is being reduced. By regulating the edge inclination forwards and backwards it may at all time be ensured that the reflection energy is kept at or below a desired value. In an exemplary embodiment, the control device 20 may act as a throttle valve where opening of the throttle valve is controlled by a controlled throttling. In FIG. 2*d-e* is shown a regulated shock wave form and reflection of such a shock wave.

As an alternative to regulating the inclination of the edge, the length of the shock wave may be regulated instead. This is performed by lowering the pressure in the counter-pressure chamber to a certain remaining pressure and then closing the valve and/or keeping the pressure at desired level using the valve. The reduction of pressure to a desired pressure may be abrupt. The pressure in the chamber may, for example, be kept at a constant level. By successively increasing or decreasing the pressure to which the reduction of pressure is performed, the reflection energy may be regulated as above.

The above regulation, however, may advantageously be combined with a regulation that is also based on penetration rate. In this case, the regulation device is also provided with means for receiving a measurement value that represents the penetration rate. How to measure the penetration rate is well known to a person skilled in the art, and may, e.g., be obtained by a measuring the flow to the feed motor or by having a sensor on the impulse-generating device to detect how fast it moves along the feed beam along which it normally moves during the drilling process. By measuring the penetration rate in addition to measurement of the reflection, the regulation method may be used to, by controlling the form of the shock wave, balance the relationship between reflected energy and penetration rate so that in some way an optimum operation of the drilling device is obtained. If only the reflected energy is measured and used during the regulation, there is a risk that the edge of the shock wave is built-up under such a long time that the penetration rate is substantially reduced.

By also reading the penetration rate concurrently or in connection to the reading of the reflecting energy, the penetration rate may be compared with the previous value, and if it is shown that the penetration rate decreases substantially while at the same time the reflection only is reduced to a small extent, the regulation may be arranged to, e.g., keep the reflected energy below a set threshold value, while varying the time of reduction of pressure with the reflection energy maintained below this threshold value in order to achieve a maximum penetration rate at the same time as the reflection energy is kept under a pre-determined value. Although penetration rate per impulse may be measured according to the above, the penetration rate may be arranged to be read more seldom that the reflection, e.g., every fifth shock wave, every tenth shock wave or even more seldom, in order to obtain a reliable measurement of the penetration rate, i.e., the penetration rate per an arbitrary number of impulses may be measured.

When the regulation is then oscillating about an "optimum" point, the length and amplitude of the shock wave may be regulated as well in order to further try to improve the penetration rate. This may, in the above example, be achieved by lowering the pressure in the chamber using the control device 20, and then maintain the pressure at a certain remaining pressure. Alternatively, the pressure level in the control device may be adjusted. By controlling the control device 20, the extent in time and amplitude and build-up and stress-relieve of the shock wave be freely adjusted. Alternatively, the regulation may, of course, be performed in a reverse manner, i.e., that the length and amplitude of the shock wave is first regulated and thereafter the rise time of the edge.

It is also possible to have a regulation algorithm wherein the rise time, amplitude and length of the shock wave is concurrently regulated according to some pre-determined algorithm in order to obtain a maximum penetration rate with low reflection. When an optimum point is encountered, the regulation may be kept about this point. The regulation may further be arranged to try to obtain a new, even better point of operation at regular intervals. During adjustment of the form of the shock wave according to some algorithm, other performance than penetration rate may be included, such as straightness of the drilled hole and tightening torque of the drill string.

The above regulation may also be arranged to optimize a weighted relation between reflection energy and, for example, penetration rate, i.e., the quantities may be given various weights wherein the weighted result is regulated to a minimum level. For example, the operator may chose arbitrary weights for different performance in dependence of current priorities (for example regarding reflected energy, straightness of the hole, productivity, working life). Rock parameters or suitable values of the shock wave form may also be inputted.

In the above description the regulation has been performed by regulating the time of reduction of pressure of a counter-pressure chamber. Apart from the impulse-generating device in FIG. 1*a*, there is a number of other impulse-generating devices having counter-pressure chambers wherein the present invention advantageously may be utilized, as well as there are various ways of performing the reduction of pressure in said counter-pressure chamber. For example, in the parallel Swedish patent application 0501149-9 having the English title "Control device", and having the same filing date as the present invention, is shown numerous examples of devices having counter-pressure chambers and how the reduction of pressure of these may be regulated. Also, in the parallel Swedish patent application 0501153-1, having the English title "Impulse generator and a method for generating impulses", which application also has the same filing date as the present invention, is shown an example of another device having a counter-pressures chamber. All of these devices and methods may by used in the regulation according to the present invention.

Figure 1B:
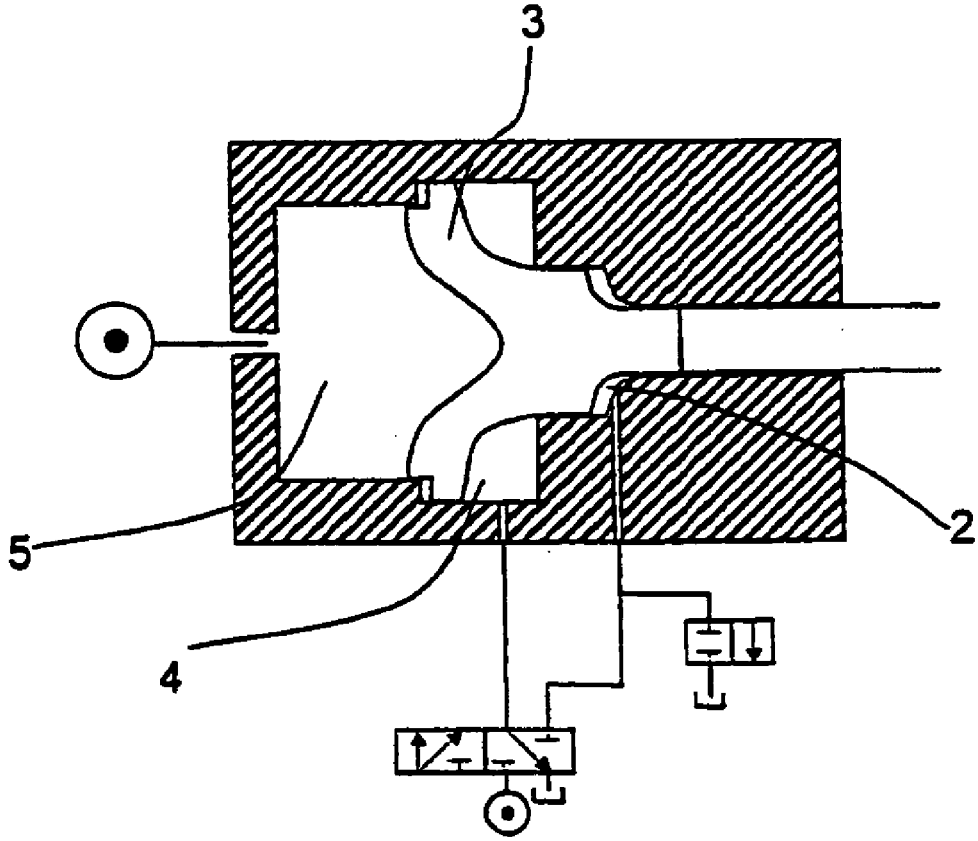

The device in the latter of the above mentioned application is shown in FIG. 1*b* and includes, apart from a counter-pressure chamber 2, a second chamber 4 acting against the impact element 3. The device further includes a main chamber 5, which preferably is constantly pressurized, said pressure being obtained by, for example, having a pressure source such as a pump which is regulated such that a constant pressure is maintained. The chamber 4 constitutes a pressure-building chamber. By pressurizing the counter-pressure chamber 2 and pressure-building chamber 4, sequentially or in parallel, and then, with a pressurized counter-pressure chamber 2, pressure-relieve the pressure-building chamber 4 the pressure in the pressurized counter-pressure chamber 2 will increase when the pressure-building chamber 4 is relieved. As to the rest this device it operates as the device described in FIG. 1*b*, however with the advantage that an even higher pressure may be obtained in the counter-pressure chamber 2, which in turn results in even larger regulation possibilities.

Figure 3A:
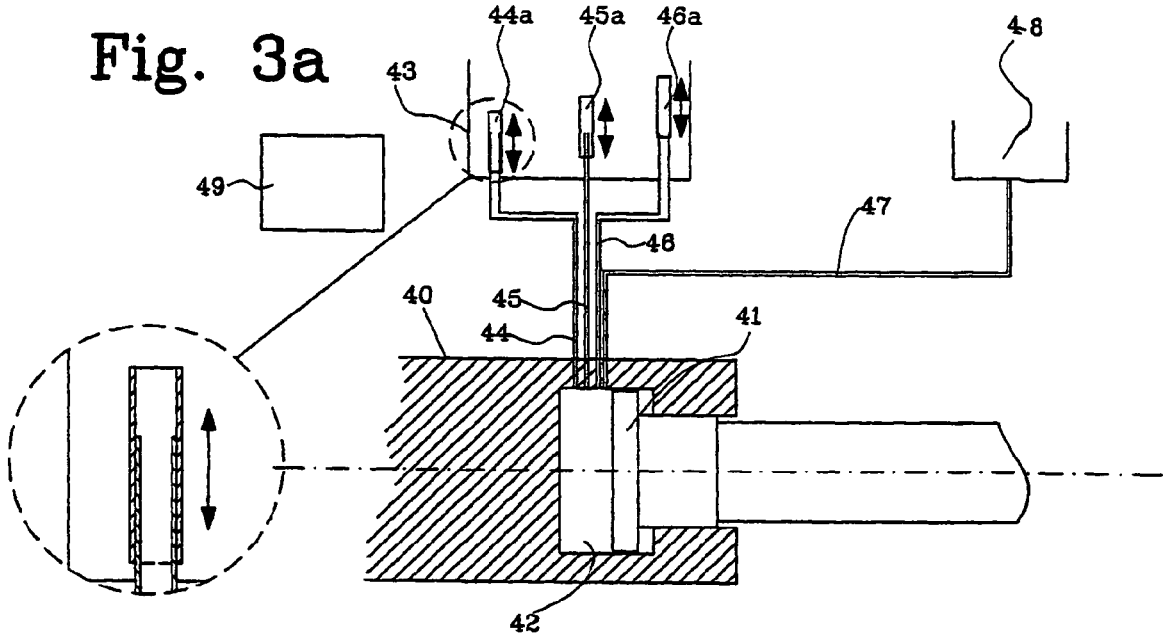
FIGS. 3*a*-*b* shows an example of another control and regulating device according to the present invention.

It has been shown above how the form of the shock wave may be regulated by controlling the reduction of pressure in a counter-pressure chamber. Apart from controlling the form of the shock wave in this way, the present invention may of course be used with an arbitrary impulse-generating device at which the form of the shock wave may be regulated. In FIG. 3*a* is shown an example of such a device 40. In this device no counter-pressure chamber is used, but a working chamber 42 is localized in front of the impulse piston 41 and shock waves are generated by supplying pressure medium having a high pressure in form of pressure pulses to the working chamber 42 from an energy storage 43, which may be localized in or outside the impulse-generating device 40, via three channels 44-46, which preferably have different cross-sectional dimensions.

By opening one or both connections between working chambers 42 and energy storage 43 a pressure pulse is obtained by the pressure increase in the working chamber, which causes a compressive stress in the impulse piston which is transferred to the drill string as a shock wave. The energy storage 43 may by of such dimension that the transfer of pressure medium to the working chamber does not result in too large a reduction of pressure in said energy storage.

When the shock wave has been generated, the connections between working chamber 42 and energy storage are closed and the pressure in the working chamber is lowered by opening a connection 46 between working chamber 42 and a pressure reservoir 48. The pressure reservoir is substantially pressure relieved. Thereafter the connection between working chamber 42 and reservoir 48 is closed and a, new stroke may by performed (the working chamber is thus pressure relieved or substantially pressure relieved at the beginning of the next pulse generation). When a connection between energy storage 43 and working chamber 42 is opened, a part of this wave will, when the pressure medium wave reaches the working chamber 42, reflect back to the energy storage 43 as a negative pressure wave, which in the energy storage is re-reflected whereat a new positive wave directed towards the working chamber arises. This process will continue until the difference in pressure between energy storage and working chamber has leveled out. By varying the distances, i.e., the length of the channels 44-46, and the time difference between the opening of the various channels 44-46, these pressure waves and pressure reflections may be utilized to form the pressure build-up and thereby the form of the shock wave.

According to the present invention the regulation is, as before, performed by a regulation device 49, but instead of regulating the reduction of pressure in a counter-pressure chamber, the way in which the respective channels 44-46 are opened is now regulated, i.e., which channel is opened first and with which time difference the channels are opened. Further the lengths of the channels 44-46 may be regulated, which, i.e., may be achieved by having channels 44-46 provided with displaceable sleeves 44*a*, 45*a*, 46*a*, which are allowed to stretch a longer or shorter way into the energy storage 43. The displaceability is indicated in the figure by two-way arrows, and the sleeves 44*a*, 45*a*, 46*a* are shown in different positions. The regions within the dashed circles are also shown enlarged in the figure for the sake of clarity. The sleeve displacement mechanism is not shown since it is considered that a person skilled in the art is capable implementing such a mechanism in a suitable manner. By controlling the pressure increase in the working chamber in this manner a desired shock wave appearance may be obtained. The required input parameters may be obtained as above, i.e., for example, by measuring the pressure in a damping chamber (not shown) or by using a strain gauge. There may be arranged a table of different channel lengths and time difference settings and resulting rise time of the shock wave edge for each of these settings in the regulation device 49. Using the table the inclination of the edge may be controlled in a desired direction (i.e., more flattened or steeper) based on the reflection of the shock wave.

In an alternative embodiment the pressure increase in the working chamber in FIG. 3*a* may be regulated in a similar manner as the reduction of pressure of the counter-pressure chamber in FIG. 1*a-b*, i.e., by, for example, using a throttle valve to controllably increase the pressure in the working chamber through the throttling.

In another alternative embodiment the essentially pressure relieved reservoir 48 may be pressurized to a certain pressure, which compared to the pressure of the energy storage 43 is lower. This has as a result that the working chamber 42 thus will always be permanently pressurized and thereby be able to act as damping chamber, which means that the pressure/pressure change in the working chamber after a stroke may be used to obtain the input parameters for the regulation according to what has been described above.

As is obvious to a person skilled in the art the number of channels between energy storage and working chamber may, of course, be arbitrary, the more channels, preferably having various cross-sectional dimensions, the more regulation possibilities obtained.

Figure 3B:
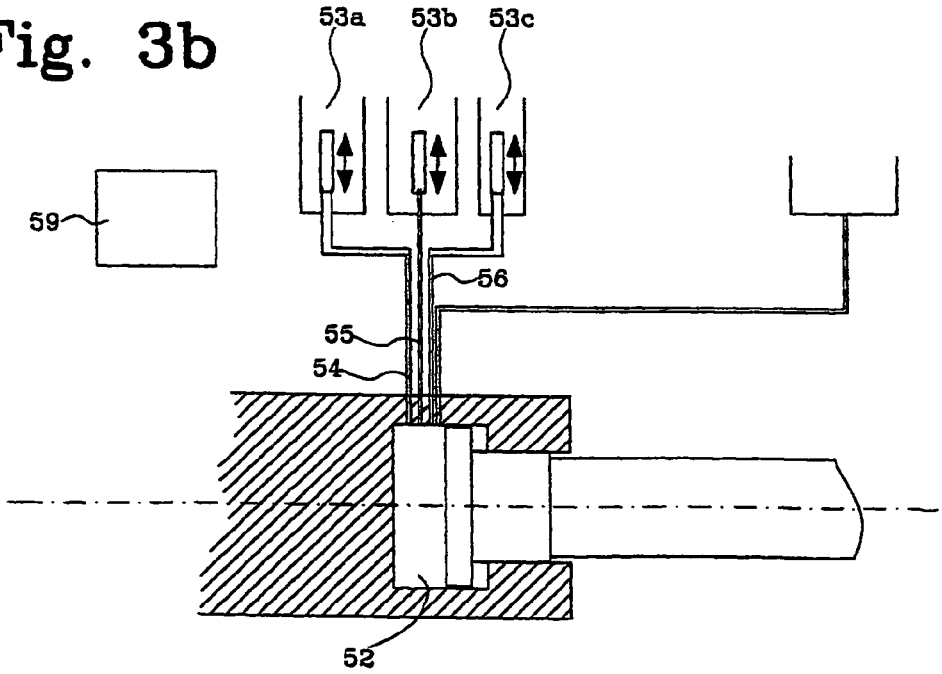

In FIG. 3*b* is shown a variant of the device in FIG. 3*a* wherein three energy storages 53*a-c* are used and which have different working pressures instead of using only one energy storage 43 having a single pressure. By connecting the energy storages 53*a-c* sequentially, e.g., the storage having the lowest pressure first, another possibility of regulating the structure of the shock wave is achieved, e.g., stepped. Naturally, each energy storage 53*a-c* may be connected to the working chamber 52 by means of =a channel 54-56 having adjustable length, or by means of two or more channels according to the above. This embodiment thus allows a very free regulation of the form of the shock wave. Naturally, an arbitrary number of energy storages having different pressures may be utilized. The regulation of the form of the shock wave using the regulation device 59 is preferably based on values stored in a table here as well.

A plurality of examples of suitable impulse-generating devices for which the present invention is applicable have been described in the above description, but, as will be recognized by an expert in the field, the present invention can, of course, be used with any impulse-generating device where a reduction of pressure in one (or more) counter-pressure chambers is used to generate a shock wave. The impulse drilling mentioned in the above description can of course be combined with a rotation of the drill strings in the usual way for the purpose of achieving drilling where the drill elements of the drill bit encounters new rock at each stroke (that is, does not make contact in a hole that has been made by the previous impact). This increases the penetration rate.

Further, in the above description nothing has been mentioned about impulse frequency. Normally, as high as possible an impulse frequency is desired in order to utilize the drilling rig resources to a maximum. The above regulation, however may of course be combined with regulation of impulse frequency, this may be particularly interesting during collaring and when there are high demands on straightness on the whole.

The invention claimed is:

1. Regulating device at an impulse-generating device for inducing a shock wave by means of a pressure pulse in a tool, said impulse-generating device comprising an impact element for transmitting said shock wave to said tool, whereby in operation a portion of the energy of the shock wave is transmitted to a rock by means of the tool and a portion of the energy of the shock wave is reflected and brought back to the impulse-generating device as reflected energy, characterized in that the regulating device comprises:

means for generating at least one parameter value that represents the reflected energy, and means for regulating the interaction of said impact element with said tool at least partially based on said value or values to control rise time and/or length of said shock wave.

2. Device according to claim 1, characterized in that said device comprises means for regulating the interaction of said impulse device with the tool such that the reflected energy is minimized.

3. Device according to claim 1, characterized in that said device further comprises means for controlling amplitude of said shock wave.

4. Device according to claim 1, characterized in that said means for generating said value or values includes means for sensing, monitoring, measurement or calculation of a quantity representing the reflected energy.

5. Device according to claim 4, characterized in that the quantity representing the reflected energy consists of at least one damping pressure in at least one damping chamber.

6. Device according to claim 1, characterized in that said device further comprises means to perform said regulation also based on penetration rate.

7. Device according to claim 1, characterized in that said means for generating at least one parameter value representing the reflected energy includes means for generating said value or values continuously, acyclic, with pre-determined intervals and/or when generating each or certain shock waves.

8. Device according to claim 1, wherein said impulse-generating device comprises a counter-pressure chamber acting on the impact element for reception of a first liquid volume intended to be pressurized and means for lowering a pressure in the counter-pressure chamber, characterized in that said means for regulating the interaction of said impact element with said tool includes a control device comprising regulating means for regulating reduction of pressure in said counter-pressure chamber.

9. Device according to claim 8, characterized in that said device further includes a second chamber acting on said impact element, constituting a pressure-building chamber, for reception of a second liquid volume intended to be pressurized, wherein said impact element moves in a direction from said tool when pressurizing the pressure-building chamber, wherein in operation the pressure in said counter-pressure chamber when pressurized increases when pressure in said pressure-building chamber is reduced.

10. Device according to claim 1, wherein said impulse-generating device comprises at least one working chamber for receiving a liquid volume intended to be pressurized, characterised in that said means for regulating the interaction of the impact element with the tool includes means for regulating at least one channel between said working chamber and an energy storage, wherein the length and/or cross-section of said inflow channel is regulated.

11. Device according to claim 10, wherein a plurality of inflow channels having adjustable length and/or adjustable cross-sections connect said energy storage with said working chamber, wherein said means for regulating the interaction of the impact element with the tool includes means for opening the inflow channels sequentially and/or in parallel.

12. Device according to claim 10, wherein a plurality of energy storages having different pressure levels are connected to said working chamber by means of inflow channels, wherein the regulation device includes means for regulating pressure build-up in the working chamber by sequentially open channels between said plurality of energy storages and said working chamber.

13. Device according to claim 1, wherein said regulating means includes calculation means such as a computer.

14. Impulse-generating device, characterized in that said impulse-generating device includes a regulating device according to claim 1.

15. Drilling rig, characterized in that said drill rig includes a regulating device according to claim 1.

16. Device according to claim 2, characterized in that said device further comprises means for controlling amplitude of said shock wave.

17. Device according to claim 11, wherein a plurality of energy storages having different pressure levels are connected to said working chamber by means of inflow channels, wherein the regulation device includes means for regulating pressure build-up in the working chamber by sequentially opening channels between said plurality of energy storages and said working chamber.

* * * * *